US007727088B2

(12) United States Patent
Neal et al.

(10) Patent No.: US 7,727,088 B2
(45) Date of Patent: Jun. 1, 2010

(54) SLIDING IMPULSE DEVICE

(75) Inventors: Phillip H. Neal, San Rafael, CA (US); Royce Nelson, Oakland, CA (US)

(73) Assignee: Diggin Active, Inc., Emeryville, CA (US)

( * ) Notice: Subject to any disclaimer, the term of this patent is extended or adjusted under 35 U.S.C. 154(b) by 221 days.

(21) Appl. No.: 11/610,466

(22) Filed: Dec. 13, 2006

(65) Prior Publication Data

US 2007/0190507 A1 Aug. 16, 2007

Related U.S. Application Data

(60) Provisional application No. 60/772,488, filed on Feb. 13, 2006.

(51) Int. Cl.
*A63B 69/00* (2006.01)
*A63B 43/04* (2006.01)
*A63B 67/06* (2006.01)

(52) U.S. Cl. ..... 473/422; 473/446; 473/595; 473/588

(58) Field of Classification Search ..... 473/422, 473/415, 451, 588, 595, 599, 603–607, 612, 473/165, 351, 589; 273/118 D, 108.1, 108.5, 273/342
See application file for complete search history.

(56) References Cited

U.S. PATENT DOCUMENTS 336,179 A * 2/1886 Vogelsang ..... 273/126 R
2,031,240 A * 2/1936 Deest ..... 473/595
2,211,330 A * 8/1940 Hochberg ..... 273/118 D
2,362,064 A * 11/1944 Giesinger ..... 473/595
2,606,030 A * 8/1952 Tjomsland ..... 473/588
2,640,699 A * 6/1953 Garbo ..... 473/588
2,812,184 A * 11/1957 McGee ..... 473/280
3,099,450 A * 7/1963 Randall ..... 473/588
3,416,800 A * 12/1968 Randall ..... 473/588
3,887,183 A * 6/1975 Saso ..... 473/76
3,930,650 A * 1/1976 Watson ..... 473/588
4,257,599 A * 3/1981 Cutri ..... 273/108.5
4,378,653 A * 4/1983 O'Brien ..... 446/46
4,616,827 A * 10/1986 Bergland ..... 473/595
5,131,665 A * 7/1992 Myers ..... 473/600
5,224,959 A * 7/1993 Kasper ..... 482/114
5,251,908 A * 10/1993 Myers ..... 473/607
5,280,906 A * 1/1994 Vitale ..... 473/613
D350,629 S * 9/1994 Scrani ..... D30/160
5,431,397 A * 7/1995 Eckel et al. ..... 273/108.1
5,472,187 A * 12/1995 Kempf ..... 473/451
5,476,267 A * 12/1995 Gertsikov ..... 473/580

(Continued)

*Primary Examiner*—Mitra Aryanpour
(74) *Attorney, Agent, or Firm*—Michael E. Woods

(57) ABSTRACT

A structure motivated by an impulse to slide over a surface, including: an impulse-receiving portion for receiving the impulse, the impulse-receiving portion defining a section of a generally semi-hemispherical structure and produced from a foam material patterned to represent at least a portion of a sports ball; and a sliding portion, coupled to the impulse-receiving portion, for sliding contact with the surface on a contact surface of the sliding portion responsive to the impulse the contact surface having a generally planar smooth surface having a periphery surrounded by an extension of the impulse receiving portion, wherein a tumbling of a coupled combination of the impulse-receiving portion and the sliding portion is inhibited by shifting a center of gravity downward by a greater weighting of the sliding portion relative to the impulse-receiving portion.

8 Claims, 3 Drawing Sheets

U.S. PATENT DOCUMENTS 5,480,143 A * 1/1996 McMurry ..... 473/571
5,566,948 A * 10/1996 Kidd ..... 273/342
5,827,109 A * 10/1998 Krull ..... 446/373
6,264,574 B1 * 7/2001 Nelson et al. ..... 473/603
6,431,942 B1 * 8/2002 Krull ..... 446/373
6,905,430 B2 * 6/2005 Davis ..... 473/588
7,549,930 B2 * 6/2009 Rice ..... 473/165
D602,542 S * 10/2009 Oblack et al. ..... D21/707

* cited by examiner

SLIDING IMPULSE DEVICE

CROSS REFERENCE TO RELATED APPLICATIONS

This application claims the benefit of U.S. Provisional Application 60/772,488 filed on Feb. 27, 2006.

BACKGROUND OF THE INVENTION

The present invention relates generally to impulse-receiving devices for sliding over a surface responsive to an impulse, and more particularly to impulse-receiving devices fashioned to be evocative of sports equipment suitable for management by young children that impart such impulses through kicking or striking with hand-held implements.

Participation in various sporting activities by children has many advantages in beginning to teach various fundamentals of teamwork, technique, and body coordination skills useful in many contexts. Unfortunately for very young children (about four to six years of age), the equipment used for some of these sporting activities is not suitable, either because the equipment is too large, requires a certain amount of skill that exceeds the abilities of the children just to begin participation, or are otherwise unwieldy so that participation is difficult if even possible, delaying development of some of the desired fundamentals and limiting enjoyment of participation in these sporting activities.

Two classes of sporting activities are particularly difficult, one class includes sporting activities in which a ball is kicked, another is a class in which a ball or puck is struck by a stick or other implement. Balls are very difficult for a very young child to manage in this context as the balls are usually large relative to the child, the bill will roll or move away from the child relatively easily, the conventional ball often has a relatively large mass that can cause injury to another child or property when mismanaged, particularly with energetic but undisciplined kicking or striking. Especially because very young children often play indoors, risk to property from use of conventional sports equipment may be higher than desired.

These factors make participation in sporting activities that use conventional balls difficult if even possible, and hence any positive development skills are delayed. The very young child may develop motor skills, coordination, and derive enjoyment from participation if the equipment were appropriately adapted to accommodate their physical abilities and training while also reducing opportunities for injury to themselves, others, and property.

What is needed is an impulse-receiving device suitable for use by very young children participating in modified sporting activities that reduces at least some of the drawbacks of conventional ball systems while preserving and/or enhancing many of the advantages of participation in these sporting activities.

BRIEF SUMMARY OF THE INVENTION

Disclosed is an apparatus and method for an impulse-driven sliding device primarily for use by young children to simulate desired attributes of ball or puck games while adapting specified attributes to promote safe, effective use for those having reduced training and/or motor-skills. The apparatus includes a structure motivated by an impulse to slide over a surface, including: an impulse-receiving portion for receiving the impulse, the impulse-receiving portion defining a section of a generally semi-hemispherical structure and produced from a foam material patterned to represent at least a portion of a sports ball; and a sliding portion, coupled to the impulse-receiving portion, for sliding contact with the surface on a contact surface of the sliding portion responsive to the impulse the contact surface having a generally planar smooth surface having a periphery surrounded by an extension of the impulse receiving portion, wherein a tumbling of a coupled combination of the impulse-receiving portion and the sliding portion is inhibited by shifting a center of gravity downward by a greater weighting of the sliding portion relative to the impulse-receiving portion. The method includes a) receiving an impulse at a top portion of a device including the top portion coupled to a bottom sliding plate and converting the impulse to a non-tumbling, non-rolling, non-launching translating force; and b) sliding, responsive to the non-tumbling, non-rolling, non-launching translating force, the device over a generally planar surface.

Embodiments of the present invention include a sliding ball for use in soccer or hockey—or other similar game. It's primary, but not exclusive, benefit is to be played safely indoors—a) it is soft b) it is designed to move low to the ground so as not to break anything 3) it is designed not to roll away so the player can easily keep control of it. Disclosed is an impulse-receiving device suitable for use by very young children participating in modified sporting activities that reduces at least some of the drawbacks of conventional ball systems while preserving and/or enhancing many of the advantages of participation in these sporting activities.

DETAILED DESCRIPTION OF THE INVENTION

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
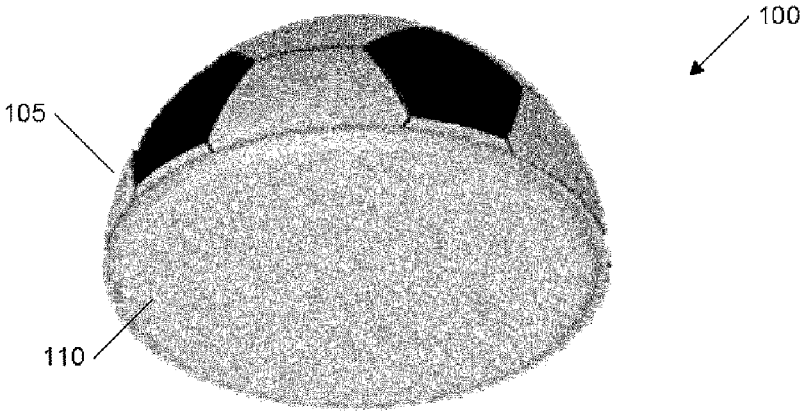
FIG. 1 is a perspective view of a first embodiment of an impulse-receiving device embodying the present invention.

FIG. 1 is a perspective view of a first embodiment of an impulse-receiving device 100 embodying the present invention. Device 100 includes two portions: an impulse-receiving top portion 105 and a sliding bottom portion 110. Device 100 includes a number of features, materials, and characteristics that promote minimization of tumbling when receiving an impulse. As shown in FIG. 1, top portion 105 simulates a section of a soccer ball—being patterned and textured to be suggestive of such a ball.

Top portion 105 is preferably constructed of lightweight/low-density foam material that may be patterned/textured/ colored and the like. Alternatively, other constructions may include an inflated air bladder or a skeletal/wire frame construction. In the embodiments evocative of a "ball"—such as for a soccer ball or a playground ball, top portion is produced as a hemisphere or a section of hemisphere given other considerations as explained herein. In some implementations, top portion 105 may be a full spherical component.

Bottom portion 110 is a substantially planar polymer/polycarbonate/plastic component having a balanced coefficient of friction factoring in a desire to easily slide over a variety of surfaces while not being so "slippery" that the intended user group has difficulty in managing device 100 with it moving too easily out of reach. Different implementations balance these factors over a range appropriate for the intended surface or surfaces and age/skill level of the intended user group. Bottom portion 110 includes a surface contacting portion that is typically polished to achieve the desired coefficient of friction while other embodiments include raised bumps, rings or a series of small, flat polymer components with a low coefficient of friction, to achieve the desired slide effect. Bottom portion preferably has a diameter in a range of about two inches to about fifteen inches and more preferably in a range of about four inches to about eight inches, and most preferably about six inches. Some embodiments may not be circular and could include some other profile.

The desired surface are typical of play surfaces and include a multitude of flat, slick surfaces (carpet, linoleum, wood, grass, concrete, blacktop, and the like) when motivated by kicking the ball component.

In use, device 100 rests over a surface by contacting bottom portion 110 to the surface and exposing top portion 105 for receipt of an impulse. In the preferred embodiment, a user applies the impulse, such as by kicking or striking top portion 105 with an implement and device 100 slides over the surface in response to the impulse without tumbling or leaving the ground. When device 100 comes to rest, it remains at rest absent receipt of another impulse. Device 100 dampens responses to low-force impulses, thus making device slide but a little distance if at all in response to a similar impulse that, when applied to a conventional ball on the similar surface, would cause the conventional ball to travel a much larger distance. A key element is that the little distance and larger distance are related to within "reach" of the user in that the little movements of device 100 maintain device 100 within reach of the user while the larger distance places the conventional device outside this reach. An impulse of sufficient magnitude evidencing a definite desire to move device 100 is required to cause device 100 to slide such a larger distance. An ability for younger children to easily maintain device 100 within reach while also easily moving it beyond reach when desired is an element of preferred embodiments of the present invention. Inhibiting tumbling, rolling, or "end-over-end" movement and relying on sliding relative movement with an appropriate coefficient of friction helps to achieve this element.

One or more of the following systems may be employed to promote minimization of tumbling (which also promotes inhibition of device 100 from becoming air-borne in response to the impulse) over a surface upon which device 100 slides. The systems include: i) a relative density difference between said portions, ii) an anti-tumbling cross-section of the top portion, iii) a lowered center-of-gravity, iv) a reduced gap between the surface and the top portion, v) a low profile relative to lateral expanse, and vi) combinations thereof.

The relative density difference may be achieved by use of a low-density, light-weight foam top portion 105 (or bladder or frame as noted above) and a relative dense hard polymer/polycarbonate bottom portion 110. The exposed top portion 105 being low density helps to dampen impulsive forces and moderate response to exuberant children.

The anti-tumbling cross-section refers to use of rounded components and preferably less than fully hemispherical section for top portion 105 to reduce an ability to apply the impulse to a surface that can lift/launch device 100. That is, by exposing surfaces all less than perpendicular for receipt of the impulse, a component of the impulsive force tends to always be downward into the surface, thus maintaining device 100 in contact with the surface. A young child has a more difficult time of accidentally catching an edge or otherwise lifting or launching device 100 when kicked.

A lowered center-of-gravity is achieved not only by using the light-weight top portion and dense bottom portion, but also distribution and coupling to minimize a height of the center of gravity above the surface. In this way, impulses applied to device 100 by the child are more likely to be above the center of gravity, improving anti-tumbling characteristics.

A reduced gap between the surface and top portion 105 helps to resist tumbling. While device 100 includes top portion 105 coupled to bottom portion 110, bottom portion 110 preferably is inset into top portion 105 or top portion 105 includes a periphery component overlapping and covering at least part of bottom portion 110. The feature helps to inhibit tumbling by reducing an opportunity to catch an exposed edge of top portion 105. Additionally, this feature improves safety to people and property by cushioning the harder/denser bottom portion 110 when striking a person or other object.

A low profile relative to lateral expanse (e.g., top portion 105 not too tall above the surface given a diameter of bottom portion 110) helps to maintain device 100 in sliding engagement over the surface. While there are several anti-tumbling parameters described, various parameters may be adjusted differently from embodiment to embodiment, implementation to implementation, and intended use to intended use such that in some devices one parameter may predominate or a set of parameters may counter-balance other parameters that may not optimally produce anti-tumbling characteristics alone without suitable adjustment of the counter-balancing parameters.

Figure 2:
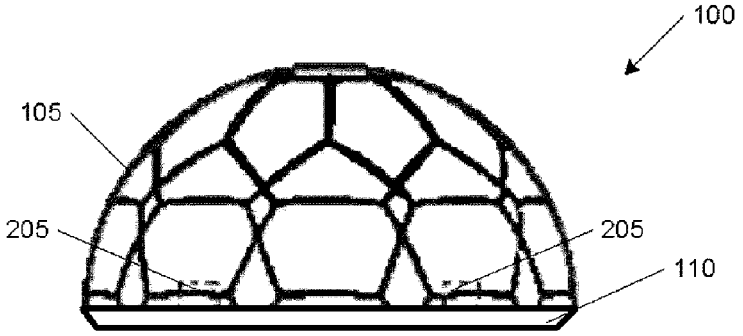
FIG. 2 is a side view of the device shown in FIG. 1.

FIG. 2 is a side view of device 100 shown in FIG. 1 illustrating an integration of top portion 105 and bottom portion 110. Top portion 105 is shown as an almost complete semi-hemisphere though other embodiments will include a lesser section. In addition, shown in FIG. 2 is a set of mating structures 205 that facilitate attachment of a rigid bottom portion 110 to a soft, pliant top portion 105. The disparate materials and construction of the portions to facilitate anti-tumbling advantageously including mating structures 205 to improve the integration and integrity of device 100 in response to repeated impulses.

Figure 3:
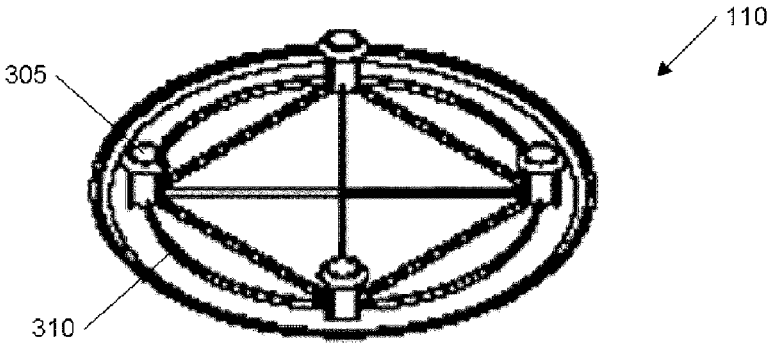
FIG. 3 is a perspective plan view of a sliding portion of the device shown in FIG. 1.

FIG. 3 is a perspective plan view of bottom portion 110 of device 100 shown in FIG. 1. FIG. 3 illustrates an example of the mating structures shown in FIG. 2, specifically a set of four posts 305 and sets of interconnecting splines 310. Not all embodiments would include both posts 305 and splines 310 or may include other mating structures.

Figure 4:
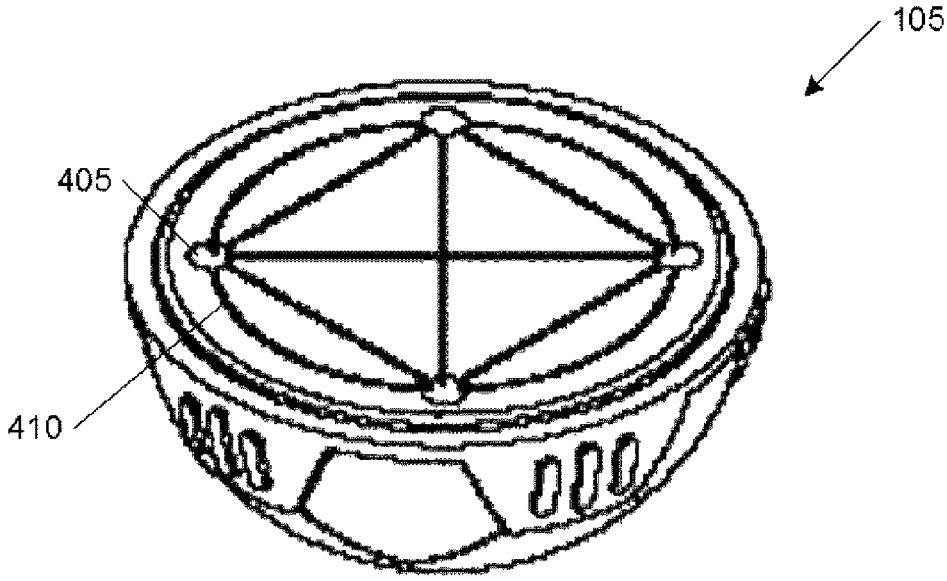
FIG. 4 is a perspective plan view of a bottom of the impulse-receiving portion of the device shown in FIG. 1.

FIG. 4 is a perspective plan view of an underside of top portion 105 of device 100 shown in FIG. 1. Top portion 105 includes complementary mating receptacles for mating structures shown in FIG. 2. Specifically, each mating post 305 matches a mating receptacle 405 and each mating spline 310 matches a complementary mating slot 410.

Figure 5:
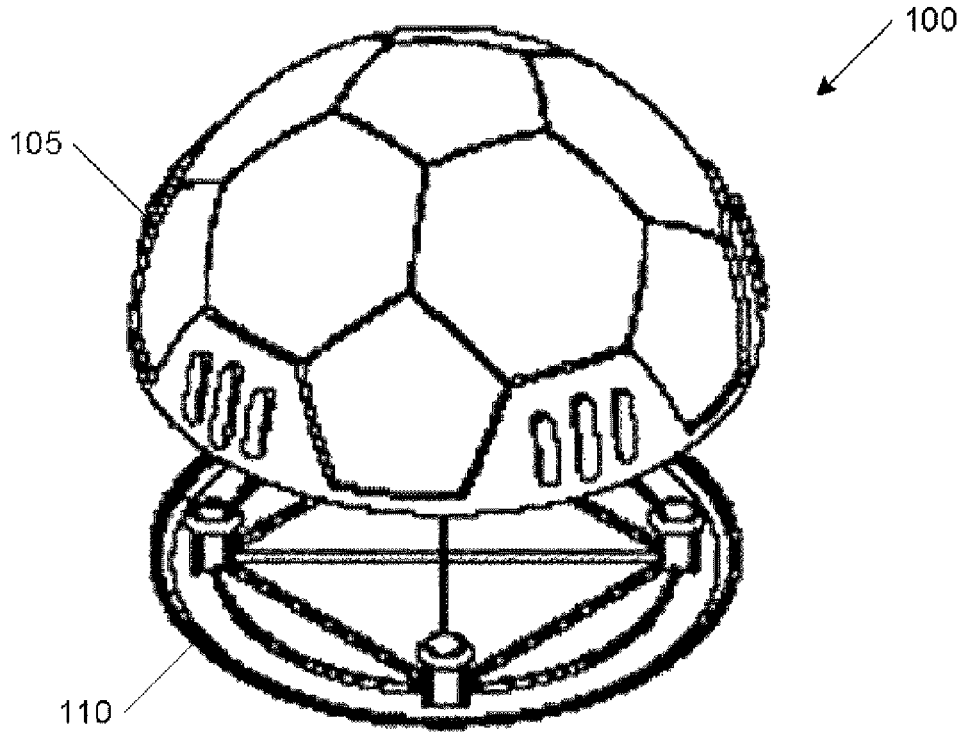
FIG. 5 is an exploded detail view of the device shown in FIG. 1.

FIG. 5 is an exploded detail view of device 100 shown in FIG. 1. Device 100 is formed by matching mating structures and applying epoxy or other adhering method or component or layer between the portions to integrate them together.

Figure 6:
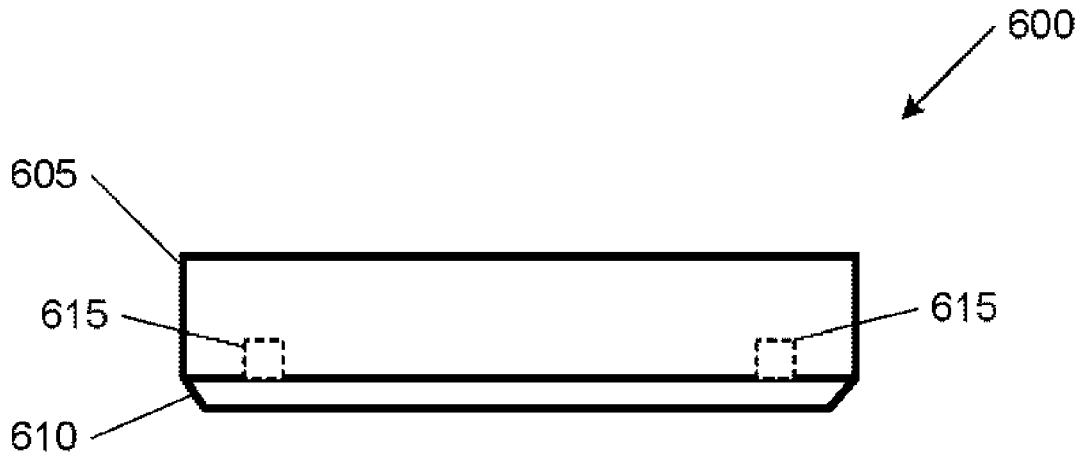
FIG. 6 is a side view of a second embodiment of an impulse-receiving device embodying the present invention.

FIG. 6 is a side view of a second embodiment of an impulse-receiving device 600 embodying the present invention. Device 600 is shaped similar to a puck having a diameter in a range of about two inches to about fifteen inches and more specifically in a range of about two to four inches for a more conventional puck size and about four inches to about fifteen inches for an "Easy Strike" puck size.

Device 600 includes a top portion 605 (similar in material and arrangement other than profile and patterning to top portion 105 shown in FIG. 1), a bottom portion 610 similar to bottom portion 110 except sized appropriately to match top portion 605, and mating structures 615 used to enhance integration of the disparate materials and resist separation during use.

Figure 7:
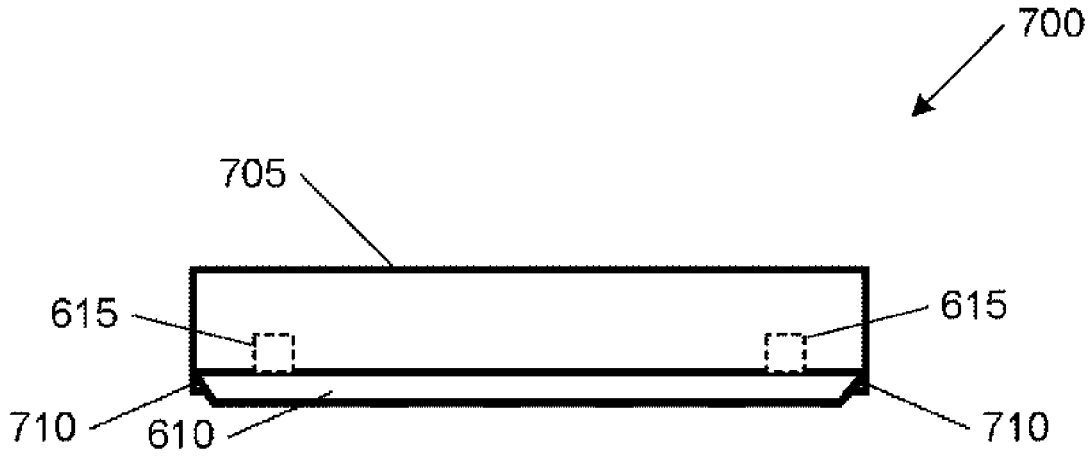
FIG. 7 is side view of an alternate embodiment of the present invention.

FIG. 7 is side view of an alternate embodiment for a device 700 embodying the present invention. While FIG. 7 depicts alternatives to device 600 shown in FIG. 6, the alternate construction is also applicable to device 100 when necessary or desirable. Device 700, similar to device 600, includes a top portion 705 that includes bottom portion 610 as an inset such that a peripheral portion 710 of top portion 705 surrounds and cushions a periphery of bottom portion 610. This peripheral portion 710 not only shields against direct contact of hard bottom plate 610 with people or objects, it also reduces a gap between a surface over which bottom portion contacts and slide and top portion 705, enhancing anti-tumbling configurations.

Soccer/Kick Embodiment

Soccer/Kick Method

Soft (foam, inflated etc.), lightweight "ball" component anywhere from half ball shape (in current manifestation) to full-round ball coupled above a substantially flat polymer component with low friction coefficient properties. Said components designed specifically to slide—with or without horizontal (spin like a globe) rotation—on any flat surface when motivated by kicking. Said components designed specifically not to roll, or tumble, vertically (end over end) when kicked. Said components designed specifically not to "roll away" (like a typical soccer ball) from the user unless motivated by kicking. Said components designed to provide weight distribution and shape to keep flat polymer component in contact with the flat surface, and make it unlikely that it will leave the ground. Said components designed to slide on a multitude of flat, slick surfaces (carpet, linoleum, wood, grass, concrete, blacktop, and the like) when motivated by kicking the ball component. Said components designed to have all soft exposed edges for improving safety for all age players. Alternative flat polymer component arrangements could include raised bumps, rings or a series of small, flat polymer components with a low friction coefficient, to achieve the desired slide effect. Said components may be as small in diameter as a miniature "ball-like puck" (perhaps 3-4"d) to a full sized soccer ball to an oversized playground-style ball. Alternate ball design comprising a skeleton structure attached to polymer component for same use as above.

Alternative Embodiment

Hockey/Hit Method

Soft (foam, inflated etc.), lightweight "puck" component coupled above a substantially flat polymer component with low friction coefficient properties. Said components designed specifically to slide—with or without horizontal (spin like a globe) rotation—on any flat surface when motivated by hitting with hockey stick or the like. Said components designed specifically not to roll, or tumble, vertically (end over end) when hit with hockey stick or the like. Said components designed specifically not to "roll away" (like a typical hockey puck on ice) from the user unless motivated by hitting with hockey stick or the like. Said components designed to provide weight distribution and shape to keep flat polymer component in contact with the flat surface, and make it unlikely that it will leave the ground. Said components designed to slide on a multitude of flat, slick surfaces (carpet, linoleum, wood, grass, concrete, blacktop, and the like) when motivated by hitting the puck component. Said components designed to have all soft exposed edges for improving safety for all age players. Alternative flat polymer component arrangements could include raised bumps, rings or a series of small, flat polymer components with a low friction coefficient, to achieve the desired slide effect. Said components may be as small in diameter as a miniature "puck" (perhaps 2-4"d) to an oversized puck (4"-15") for easier hitting and younger aged users.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the Unites States is:

1. An apparatus motivated by an impulse to slide over a ground surface, comprising:

an upper impulse-receiving portion for receiving an impulse when applied by a person striking said impulse-receiving portion with his foot wherein said impulse receiving portion has a diameter in a range of about two inches to about fifteen inches, wherein said impulse receiving portion includes an exterior component configured to resemble a portion of an athletic ball;

a lower sliding portion, coupled to said impulse-receiving portion, for sliding contact with the surface responsive to an impulse, said sliding portion including a generally planar component having a diameter no greater than the diameter of said impulse-receiving portion; wherein said impulse-receiving portion at least partially overlaps a periphery of a circumference of said sliding portion to cushion said sliding portion when striking an object; and means for matingly attaching said upper impulse-receiving portion to said lower sliding portion; and wherein a center of gravity of said impulse-receiving portion and said sliding portion is shifted towards the surface by use of a low-density material for said impulse-receiving portion and a high-density material for said sliding portion.

2. The apparatus of claim 1 wherein said sliding portion includes an exposed edge extending from the ground surface to said impulse-receiving portion wherein said exposed edge is not generally perpendicular to the ground surface.

3. The apparatus of claim 1 wherein a height of said coupled sliding portion and said impulse-receiving portion above the ground surface is less than said diameter of said generally planar component.

4. The apparatus of claim 2 wherein a height of said sliding portion and said impulse-receiving portion above the ground surface is less than said diameter of said generally planar component.

5. An apparatus motivated by an impulse to slide over a ground surface, comprising:

an upper impulse-receiving portion for receiving an impulse when applied by a person striking said impulse-receiving portion with an implement held in at least one hand of the person, wherein said impulse receiving portion has an impulse-receiving portion diameter in a range of at least about two inches to no more than about fifteen inches and, wherein said impulse-receiving portion includes an exterior component configured to resemble a puck used in sporting events; and a lower sliding portion, coupled to said impulse-receiving portion, for sliding contact with the surface responsive to an impulse, said sliding portion including a generally planar component having a diameter no greater than the diameter of said impulse-receiving portion;

said upper impulse-receiving portion further including a plurality of posts and sets of interconnecting splines, and said lower sliding portion including complementary mating receptacles for mating said plurality of posts and complementary slots for mating said sets of interconnecting splines; and wherein said impulse-receiving portion at least partially overlaps a periphery of a circumference of said sliding portion to cushion said sliding portion when striking an object; and wherein a center of gravity of said impulse-receiving portion and said sliding portion is shifted towards the surface by use of a low-density material for said impulse-receiving portion and a high-density material for said sliding portion.

6. The apparatus of claim 5 wherein said sliding portion includes an exposed edge extending from the surface to said impulse-receiving portion wherein said exposed edge is not generally perpendicular to the ground surface.

7. The apparatus of claim 5 wherein a height of said sliding portion and said impulse-receiving portion above the ground surface is less than said diameter of said generally planar component.

8. The apparatus of claim 6 wherein a height of said coupled sliding portion and said impulse-receiving portion above the surface is less than said diameter of said generally planar component.

* * * * *